United States Patent [19]

Kringen et al.

[11] Patent Number: 4,996,517

[45] Date of Patent: Feb. 26, 1991

[54] HOUSEHOLD ALARM SYSTEM

[75] Inventors: Dale E. Kringen; Thomas D. Culhane, both of Sioux Falls, S. Dak.

[73] Assignee: Assist, Inc., Sioux Falls, S. Dak.

[21] Appl. No.: 334,722

[22] Filed: Apr. 6, 1989

[51] Int. Cl.[5] ..... G08B 29/00

[52] U.S. Cl. ..... 340/506; 340/507; 340/531; 340/532; 340/533; 340/538; 340/539

[58] Field of Search ..... 340/506, 539, 531, 507, 340/532, 533, 538

[56] References Cited

U.S. PATENT DOCUMENTS

| | | | |
|---|---|---|---|
| 3,624,635 | 11/1971 | Less | 340/326 |
| 3,833,895 | 9/1974 | Fecteau | 340/539 |
| 3,863,236 | 1/1975 | Clardy | 30/326 |
| 3,925,763 | 12/1975 | Wadhwani et al. | 340/539 |
| 4,241,332 | 12/1980 | Farque | 340/326 |
| 4,288,784 | 9/1981 | Fusco | 340/326 |
| 4,730,184 | 3/1988 | Bach | 340/691 |

*Primary Examiner*—Donnie L. Crosland
*Attorney, Agent, or Firm*—Kinney & Lange

[57] ABSTRACT

An alarm system providing external alarm signals for a structure. The alarm system includes transmitters for generating coded radio trigger signals. An alarm controller located in the interior of the structure is responsive to the coded radio trigger signals for generating alarm actuation signals. The alarm actuation signals are transmitted to alarm signal generators located on the exterior of the structure. Transmission lines for the alarm actuation signals are connected between the alarm controller and the alarm signals generators. Integrity determination of the transmission lines is provided by detection of a break in a current loop provided by a ground line and a ground sense line connected between the controller and the alarm signal generators along side the transmission lines.

7 Claims, 2 Drawing Sheets

HOUSEHOLD ALARM SYSTEM

BACKGROUND OF THE INVENTION

1. Field of the Invention

The present invention relates to alarm systems, and more particularly to a low cost alarm system for houses located in a neighborhood setting. The alarm system is adapted for alerting neighbors, and uses neighbor or passerby intervention to summon emergency personnel.

2. Description of Prior Art

Household security and burglar alarm systems are commonplace. Typically such systems provide sensors such as infrared sensors keyed by body heat or sound sensors keyed by noise for sensing the presence of intruders. An alarm condition can then be declared by a controller for the sensors and detectors which is used to set of a local alarm, to transmit an alarm signal to a subscriber company which watches for such alarm conditions in households, or both.

Such household security systems are expensive to install, expensive to maintain and expensive to operate. They can be characterized by inflexibility, being geared to intruder detection at times when the residents of the house are away or have substantially confined their movements to a small portion of the dwelling. Such systems generally do not address the needs of individuals, particularly individuals living alone, for an alarm system that can be used to alert neighbors for aid in event of accident or illness, an alarm system which can be used by an individual to alert neighbors upon detection of an intruder within the dwelling place, or an alarm system which alerts neighbors upon activation of conventional smoke alarms.

One system partially directed to these needs is proposed in U.S. Pat. No. 4,730,184. The reference teaches a low cost exterior alarm system providing sound and light source alerts for a house. The alarm system is actuated at the resident's or houseowner's command and provides for delayed or deadman switching to set off the alarm under certain circumstances. It is a system primarily directed to resident response to an intruder and provides no automatic features responsive to conditions relating to fire or cold which also could affect occupants or occur when the occupants are not at home.

SUMMARY OF THE PRESENT INVENTION

The present invention provides an alarm system for a house including alarm signal generators positioned exterior to the house, a alarm controller located in a secure or hidden part of the house, the alarm controller being responsive to radio trigger signals, portable radio trigger signal transmitters adapted to be worn by residents of the house, signal transmission connections between the alarm controller and the alarm signal generators for carrying alarm actuation signals, and an integrity circuit for sensing a break in the signal transmission connections. Typically the system includes at least one portable, battery powered radio transmitter adapted to be worn by a resident or visitor to the house for transmitting the radio trigger signals and thereby causing the alarm controller to transmit actuation signals to the alarm signal generators. Alternatively, or in addition to the portable radio transmitter, the system can include a radio transmitter actuated by the sound of the alarm of a conventional smoke detector Other condition alerting systems, such as intruder alarms adapted to give a sounded warning or temperature alert systems giving a sounded warning can also be used to actuate a sound responsive radio transmitter.

The use of portable, battery powered radio transmitters responsive to either human actuation or to particular sounded alarms provides an adaptable system for alerting neighbors of a problem requiring response. Portable, inexpensive audio alarm generators exist for detection of breaking or entry through windows to houses, for detection of smoke, and for the detection of other potentially hazardous conditions. Additionally, the alarm system easily accommodates new sound alert products at they become available. The use of long life lithium batteries in the transmtitter contributes to low maintenance costs and effort. The alarm controller is provided with battery backup power as a substitute for failure of commercial power.

DETAILED DESCRIPTION OF THE PREFERRED EMBODIMENT

Figure 1:
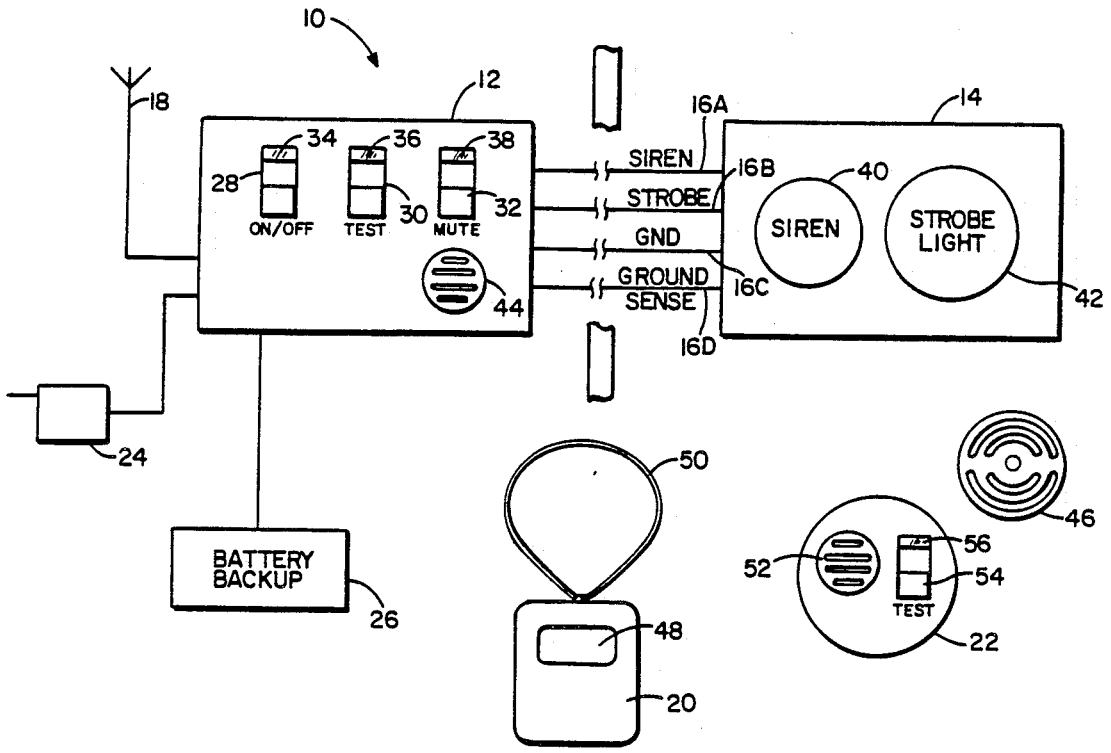
FIG. 1 is a block diagram of a household alarm system in accordance with the invention.

FIG. I illustrates the basic components of a household alarm system 10 in accordance with the present invention. Inside control console 12 transmits actuation signals on alarm actuation signal lines 16A–16D to activate an exterior alarm 14. The alarm actuation signals are generated by inside control console 12 in response to coded radio trigger signals received on antenna 18 from a portable transmitter 20 or an audio alarm responsive transmitter 22.

Control console 12 is powered by connection to a conventional electrical outlet by a plug-in power supply 24. A battery backup power source 26, which is kept charged by control console 12, may also be provided. Control console 12 has only three external switches, an ON/OFF switch 28, a TEST switch 30 and a MUTE switch 32. Each switch includes an LED indicator for indicating the status of the switch, these being LED 34 for ON/OFF switch 28, the LED 34 being lit when control console 12 is on; LED 36 for TEST switch 30, the LED 36 being lit when the control console is in its test mode; and LED 38 for MUTE switch 32, the LED 38 being lit when an audio siren 40 is deactivated.

Audio siren 40 is part of external alarm 14, which also includes a strobe light 42. External alarm 14 is preferably mounted to a relatively inaccessible, but highly visible location on the exterior of a house. External alarm 14 is both powered and actuated directly by control console 12 over alarm actuation signal lines 16A–16D. It is preferable that there be no external plug in type connection of external alarm 14 to actuation signal lines 16A–16D.

Alarm actuation signal lines 16A–16D include a siren actuation line 16A, a strobe actuation line 16B, a ground line 16C, and a ground sense line 16D. Ground line 16C and ground sense line 16D form a current loop to allow detection of breakage of actuation lines 16A–16D, such as would occur if external alarm 14 were torn from or removed from the exterior of a house, or where the actuation lines were cut. Breakage of the current loop results in an audio alarm being sounded on piezo alarm 44 mounted in control console 12.

Transmitter 20 provides for manual triggering of alarm actuation signals by control console 12 Transmitter 20 is essentially a type of garage door type transmitter, tuned to broadcast a pulse coded signal at a frequency of about 300 MHz upon depression of a transmit button 48. A cord 50 allows the resident of the house to wear transmitter 20 about his or her neck during daily activities.

Audio alarm responsive transmitter 22 provides automatic triggering of alarm actuation signals by control console 12 in response to interior audio alarms, such as alarms generated by a smoke detector 46. Audio alarm responsive transmitter 22 has an electroacoustic transducer 52 for picking up "shriek" alarms such as those generated by smoke detectors. Any other alert device using a similar "shriek" alarm, such as a thermostat-activated device for detecting cold conditions or alarms attached to windows to be disturbed by movement, could also be used in combination with audio alarm responsive transmitter 22 for activating control console 12. Transmitter 22 also includes a TEST switch 54 with LED indicator 56, allowing transmitter 22 to be actuated without providing a "shriek" alarm.

Smoke detectors and other such devices could, of course, be adapted to generate coded radio trigger signals directly. Where audio alarm responsive transmitter 22 is used in combination with a device such as smoke detector 46, it should be placed in close physical proximity to the smoke detector.

Figure 2:
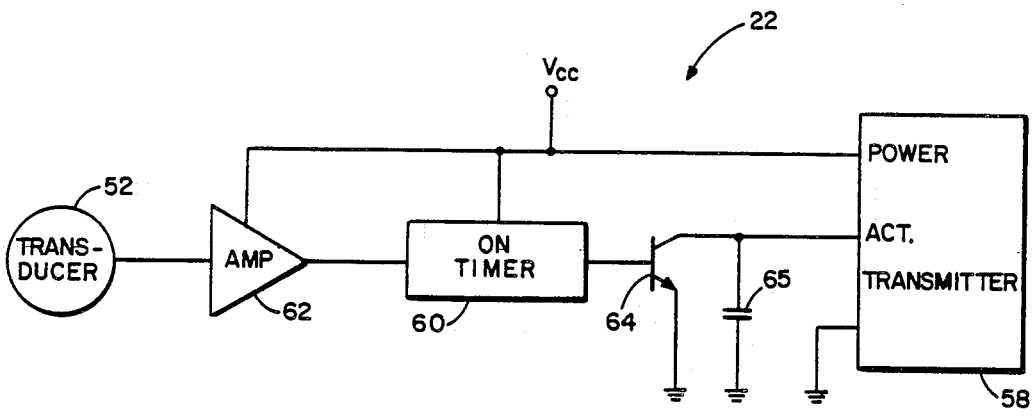
FIG. 2 is a block diagram schematic of an audio pickup alarm trigger signal generator.

FIG. 2 is a block diagram illustrating audio alarm responsive transmitter 22. Radio signal transmitter unit 58 is essentially a automatic garage door transmitter of a type well known in the art. Transmitter unit 58 includes the usual dip switches for setting a locally unique transmission code and tuning circuits for fine adjustment of the broadcast frequency. As indicated above, the preferred frequency is about 300 MHz.

Transmitter unit 58 is normally actuated by generation of a signal from electroacoustic transducer 52. Electroacoustic transducer 52 is designed to respond to high frequency sound waves such as generated by "shriek" alarms and to not respond to sound waves associated with normal conversation, music and the like. Transducer 52 also has a limited range to provide further immunity to accidental actuation. An amplifier 62 boosts the actuation signal from transducer 52 to a trigger level sufficient to actuate ON timer 60. ON timer 60 times the duration of alarms detected by transducer 52. so that brief alarm soundings, such as "chirping" sounds from smoke detectors indicating low battery levels, donot cause generation of a radio trigger signal. ON timer 60 provides a signal to the base of switching transistor 64, coupling the actuation pin of transmitter 58 to ground and thus activating transmitter 64. Capacitor 65 is charged through transmitter 58 to develop voltages on the actuation pin to turn transmitter 58 off when transistor 64 is not conducting.

Figure 3:
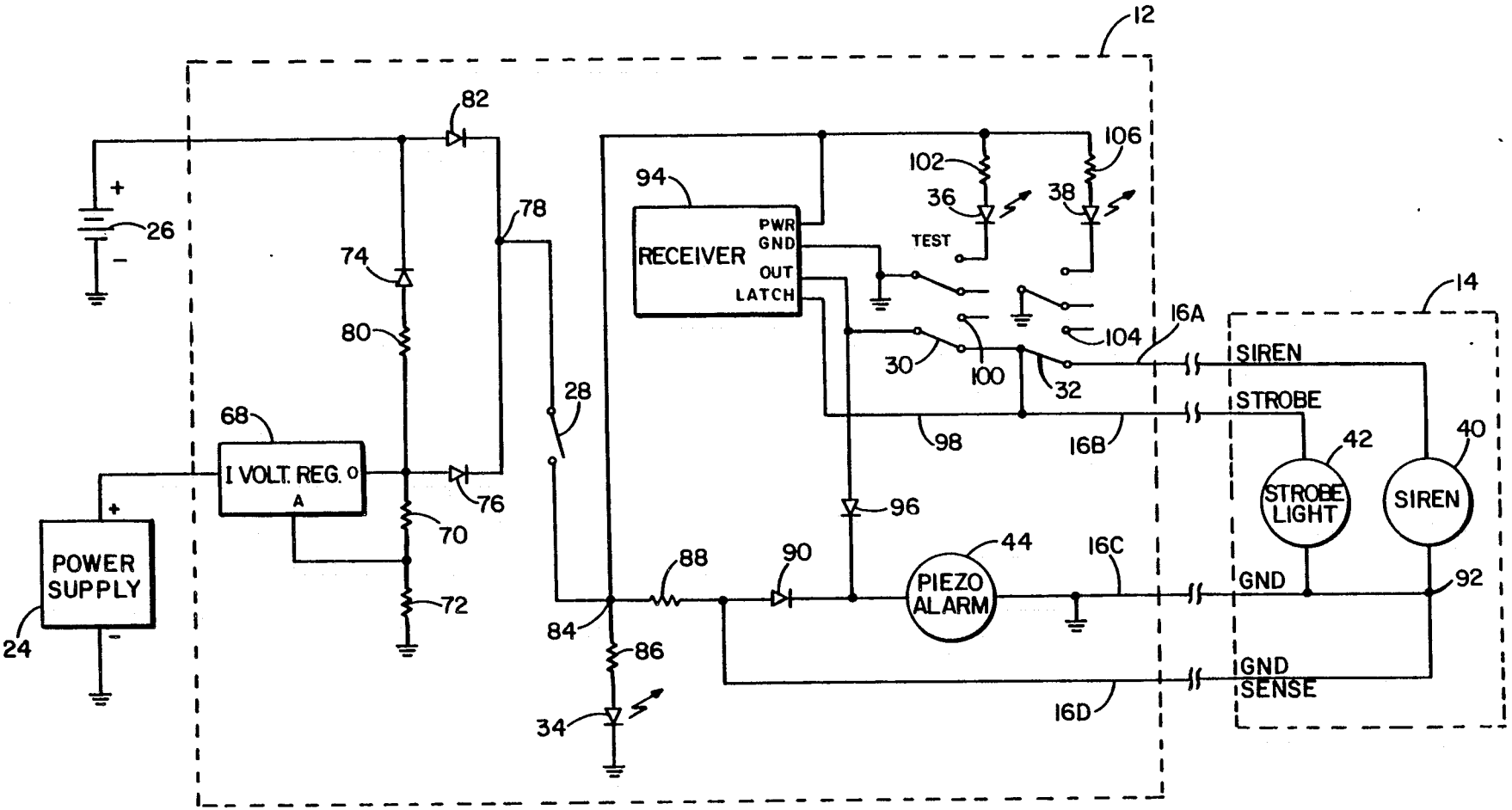
FIG. 3 is a circuit schematic for a household alarm control console and exterior alarm.

FIG. 3 is a circuit schematic of control console 12 and exterior alarm 14. Control console 12 is connected to two power sources, an unregulated 12 volt DC power supply 24 and a backup battery 26. Power supply 24 is connected to the input terminal of an LM 3I7 type voltage regulator 68. The adjustment terminal of voltage regulator 68 is connected to the node between resistors 70 and 72. The ratio of the resistances of resistors 70 and 72 is selected to provide a 14.5 v regulated voltage output on the output terminal of voltage regulator 68.

The output terminal of voltage regulator 68 is connected by diodes 74 and 76, oriented to conduct current away from the output terminal, to the positive terminal of backup battery 26 and to node 78, respectively. Current from the output terminal of voltage regulator 68 through diode 74 is limited by resistor 80 and charges battery 26. The positive terminal of battery 26 is connected by diode 82, which is oriented to conduct away from the positive terminal of the battery, to node 78. Thus, the voltage level at node 78 follows either the output terminal of voltage regulator 68 or the voltage level of the positive terminal of battery 26, less one diode drop, whichever is greater. Generally, unless power supply 24 is unavailable, voltage regulator 68 will support the voltage level on node 78.

Node 78 is connected to node 84 by ON/OFF switch 28. The balance of control console 12 and exterior alarm 14 draw power from node 84.

Node 84 is connected to ground by a current limiting resistor 86 and by ON/OFF indicating LED 34. Node 84 is connected to the current loop formed by ground sense line 16D and ground line 16C by resistor 88. A diode 90 is connected to conduct current from resistor 88 to piezo alarm 44. Absent triggering of an alarm actuation signal, or cutting of ground line 16C or ground sense line I6D however, both terminals of diode 90 will be at the same potential level and the diode will not be conducting. This follows from ground sense line I6D being connected from the node between resistor 88 and diode 90 to common node 92 of ground line 16C and the ground sense line in exterior alarm 14. Should, however, ground sense line I6D be severed, current will flow from node 84 through resistor 88 and diode 90 to piezo alarm 44 and ground, resulting in sounding of an alarm indicating loss of integrity in the system.

The alarm actuation portion of the circuit relates to the outputs of radio receiver 94. In the preferred embodiment, radio receiver 94 is an "SMR-1" type receiver manufactured by Alarm Electronics Manufacturing Company, Inc., Route 2 Box 70, Taylorsville, N.C. Receiver 94 is adapted to receive trigger signals from transmitters 20 and 22. Receiver 94 is an integrated device with four pins of interest here, a power input pin, a ground pin, an output pin and a latch pin. Other input pins such as one for attachment to antenna 18 are not illustrated for the sake of clarity.

The power input pin of receiver 94 is connected directly to node 84 to provide power to the receiver The ground pin of receiver 94 is connected to ground. Alarm actuation signals are generated on the output terminal of receiver 94. The output terminal of receiver 94 is connected to piezo alarm 44 by a diode 96, oriented to conduct electricity from the output terminal to and across the alarm to ground. Accordingly, appearance of an alarm actuation signal results in generation of an household interior alarm.

An alarm actuation signal can also result in strobe 42 firing, or both strobe 42 firing and siren 40 being sounded, depending upon the states of TEST switch 30 and MUTE switch 32, respectively. TEST switch 30, when opened as illustrated in FIG. 3, connects the output terminal of receiver 94 to switch 32. When switch 30 is closed the output terminal is connected to a blind, floating terminal 100. Closing TEST switch 30 also provides a current path from node 84 through resistor 102 and LED 36 to ground, resulting in LED being lit indicating a test mode of control console 12. Occasion of an alarm actuation signal while switch 30 is open and console 12 is in its test mode results in only piezo alarm 44 being sounded, assuming a successful test.

An opened TEST switch 30 couples an alarm actuation signal from the output terminal of receiver 94 to strobe actuation line 16B and to latch feedback line 98. Appearance of an alarm actuation signal is fed back to the latch pin of receiver 94, with the result that the alarm actuation signal on the output terminal is latched on. The alarm actuation signal can now only be removed by opening switch 28 or by closing TEST switch 30. Power is also provided strobe light 42 on strobe actuation line 16B resulting in strobe light 42 firing.

Siren 40 may be sounded as well depending upon the state of MUTE switch 32. If MUTE switch 32 is open, as illustrated in FIG. 3, the alarm actuation signal will be transmitted on siren actuation line 16A to siren 40. Ground line 16C provides a return wire for the alarm actuation signals from both strobe light 42 and siren 40. If switch 32 is closed, the alarm actuation signal will be applied to a floating terminal 104. Closure of MUTE switch 32 also provides a current path from node 84 through resistor 106 to LED 38 and ground, illuminating LED 38 to indicate that siren 40 is muted.

Household alarm system 10 provides audio and visual alarm signals through exterior alarm 14. The audio alarm signal can be muted leaving just the visual alarm of strobe light 42 as an identifying beacon for a house after help such as medical assistance has been summoned. An interior alarm over piezo alarm 44 is sounded upon receipt of a radio trigger signal, providing for convenient testing of the system. An interior alarm signal over piezo alarm 44 also occurs upon detection of a fault in alarm actuation lines 16A–16D. Portable transmitter 20 requires positive action on the part of an individual to actuate alarm system 10. Such nonautomatic devices give system 10 flexibility and reduce the possibility of false alarm. Portable transmitters 20 are intended to be worn and thereby give the individual a chance to trigger alarm system 10 as long as they remain conscious. Audio alarm responsive transmitters 22 add passive response capability to system 10 if desired. Such passive devices are not intended as a substitute security system, but instead are directed to specific situations in which assistance is needed, such as fire.

Although the present invention has been described with reference to preferred embodiments, workers skilled in the art will recognize that changes may be made in form and detail without departing from the spirit and scope of the invention.

What is claimed is:

1. An alarm system for a structure comprising:

means for generating coded radio trigger signals;

alarm controller means responsive to coded radio trigger signals for generating alarm actuation signals;

alarm signals generating means for generation of alarm signals in response to the alarm actuation signals;

an alarm actuation signals transmission line connected between the alarm controller means and the alarm signals generating mans; and means connected to the alarm actuation signals transmission line for determining integrity of the transmission line.

2. The alarm system of claim 1 wherein the alarm actuation signals transmission line includes an electrical signal conducting wire for each alarm actuation signal.

3. The alarm system of claim 2 wherein the integrity determination means includes:

a ground wire connected between the alarm controller means and the alarm signals generating means for providing a return wire for alarm actuation signals, the ground wire being connected to ground in the alarm controller means;

a ground sense wire connected between the alarm controller means and the alarm signals generating means and further connected to the ground wire to form a current loop; and interior alarm means connected in the current loop such that an interior alarm is enunciated if the current loop is broken.

4. The alarm system of claim 3 wherein the alarm signals generating means is positioned with respect to the exterior of a building in such a way as to identify the building as source of any alarm signals generated by the generating means, the alarm controller means is positioned in a secure location in the interior of the building, and the electrical signal conducting wires of the alarm actuation signals transmission lines, the ground wire and the ground sense wire pass from the secure location to the alarm signals generating means.

5. The alarm system of claim 1 wherein the means for generating coded radio trigger signals comprises:

nonautomatic coded radio trigger signals transmitter means; and automatic coded radio trigger signal transmitter means.

6. The alarm system of claim 5 wherein the automatic coded radio trigger signal transmitter means are responsive to audible alarm signals generated by smoke detectors.

7. A household alarm system comprising:

portable nonautomatic means for generating coded radio trigger signals;

household interior alarm controller means responsive to coded radio trigger signals for generating alarm actuation signals;

household exterior alarm signals generating means for generation of alarm signals in response to the alarm actuation signals;

an alarm actuation signals transmission line connected between the alarm controller means and the alarm signals generating means; and transmission line integrity determination means connected to the alarm actuation signals transmission line for detecting loss of integrity of the transmission line.

* * * * *